US011608238B2

(12) United States Patent
Hashimoto

(10) Patent No.: US 11,608,238 B2
(45) Date of Patent: Mar. 21, 2023

(54) SHEET POST-PROCESSING DEVICE

(71) Applicant: TOSHIBA TEC KABUSHIKI KAISHA, Tokyo (JP)

(72) Inventor: Yoshihisa Hashimoto, Gotemba Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/152,609

(22) Filed: Jan. 19, 2021

(65) Prior Publication Data

US 2022/0227595 A1 Jul. 21, 2022

(51) Int. Cl.

| | |
|---|---|
| ***B65H 31/36*** | (2006.01) |
| ***B65H 31/34*** | (2006.01) |
| ***B65H 7/02*** | (2006.01) |
| ***B65H 7/08*** | (2006.01) |
| ***B65H 9/10*** | (2006.01) |

(52) U.S. Cl.

CPC ..... *B65H 9/101* (2013.01); *B65H 7/08* (2013.01); *B65H 2301/331* (2013.01); *B65H 2404/733* (2013.01); *B65H 2511/24* (2013.01); *B65H 2701/1311* (2013.01); *B65H 2801/27* (2013.01)

(58) Field of Classification Search

CPC . B65H 7/08; B65H 9/101; B65H 9/20; B65H 2511/242; B65H 2404/733; B65H 31/34; B65H 31/36; B65H 2801/27; B65H 2301/331; G03G 15/6582; G03G 2215/00818

See application file for complete search history.

(56) References Cited

U.S. PATENT DOCUMENTS

| | | | | |
|---|---|---|---|---|
| 9,834,399 | B1 * | 12/2017 | Hashimoto | B65H 9/002 |
| 2009/0243201 | A1 | 10/2009 | Isogai et al. | |
| 2019/0300319 | A1 | 10/2019 | Ohashi et al. | |
| 2021/0155020 | A1 * | 5/2021 | Amano | B65H 29/14 |

FOREIGN PATENT DOCUMENTS

| | | | |
|---|---|---|---|
| JP | H06-255187 A | | 9/1994 |
| JP | 2009102084 A | * | 5/2009 |
| JP | 2015020848 A | * | 2/2015 |

* cited by examiner

*Primary Examiner* — Luis A Gonzalez
(74) *Attorney, Agent, or Firm* — Foley & Lardner LLP

(57) ABSTRACT

A sheet post-processing device is connected to a punch processing unit. The punch processing unit includes a skew detection unit and a punch unit. The skew detection unit detects a skew amount of a sheet. The punch unit forms punch holes at positions of the sheet according to the skew amount. The sheet post-processing device includes a processing tray, a paddle, a driver, and a control unit. The sheet of which the skew amount is detected by the skew detection unit is mounted on the processing tray. The paddle conveys the sheet on the processing tray by a paddle operation. The driver drives the paddle to perform the paddle operation. The control unit is configured to operate the driver to control a number of times the paddle operation is performed by the paddle based on the skew amount.

16 Claims, 11 Drawing Sheets

SHEET POST-PROCESSING DEVICE

FIELD

Embodiments described herein relate generally to a sheet post-processing device.

BACKGROUND

A sheet post-processing device performs post-processing on sheets discharged from an image forming apparatus. For example, the sheet post-processing device includes a processing tray and a stapler. The stapler binds the sheet bundle on the processing tray.

The sheet may be supplied to the processing tray in an oblique state (skewed state). In some cases, the sheet bundle may be bound in a skewed state.

DETAILED DESCRIPTION

A sheet post-processing device according to an embodiment is connected to a punch processing unit. The punch processing unit includes a skew detection unit and a punch unit. The skew detection unit detects a skew amount of a sheet. The punch unit forms punch holes at positions of the sheet according to the skew amount. The sheet post-processing device according to the embodiment includes a processing tray, a paddle, a driving unit, a matching unit, and a control unit. The sheet of which the skew amount is detected by the skew detection unit is mounted on the processing tray. The paddle conveys the sheet on the processing tray by a paddle operation. The driving unit drives the paddle to perform the paddle operation. The end portion of the sheet conveyed by the paddle operation is abutted on the matching unit. The control unit controls the number of times of the paddle operation of paddle based on the skew amount detected by the skew detection unit.

Hereinafter, the sheet post-processing device according to the embodiment will be described with reference to the drawings.

Figure 1:
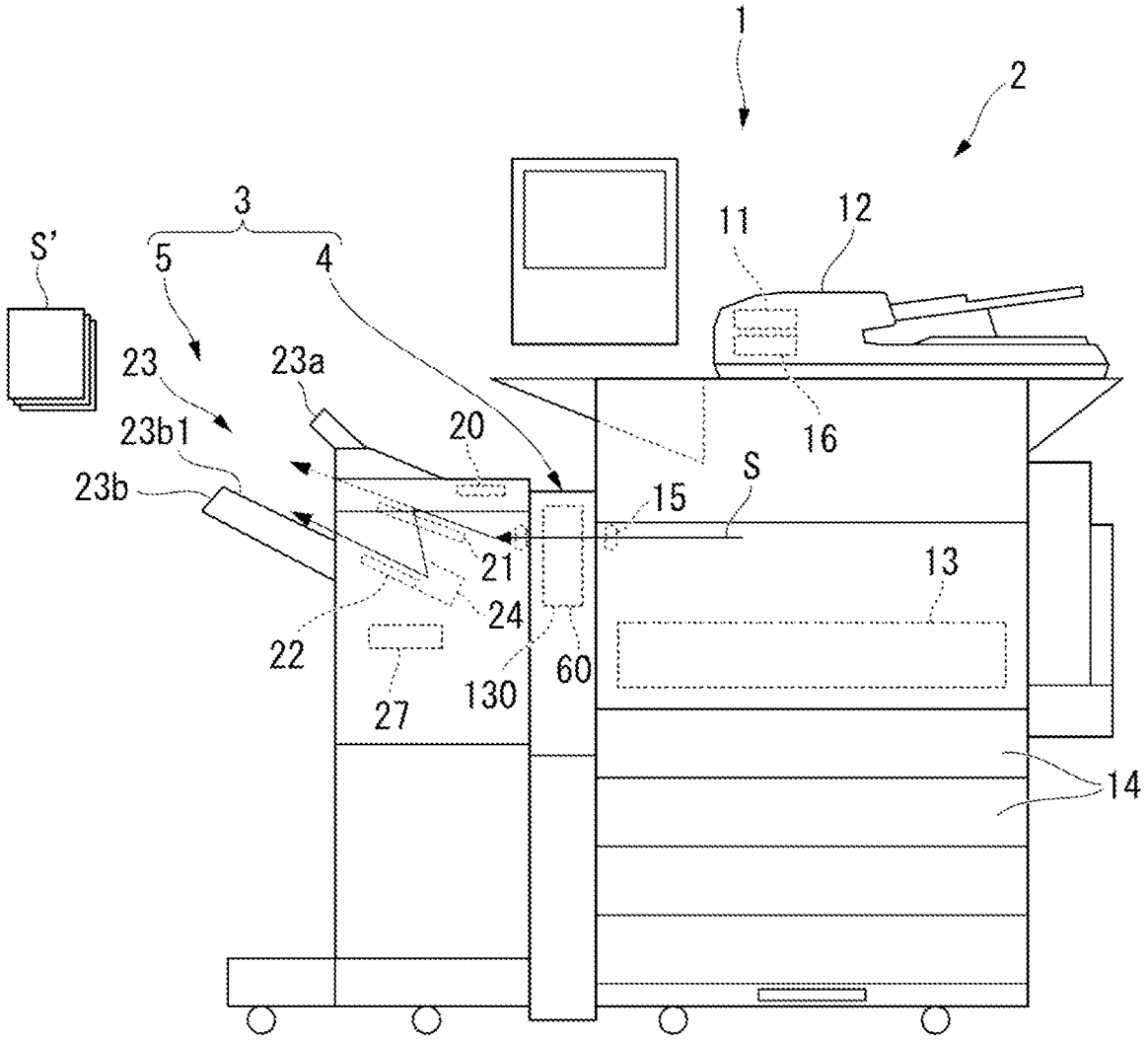
FIG. 1 is a diagram of an overall configuration example of an image forming system including a sheet post-processing device according to a first embodiment.

FIG. 1 is a diagram of an overall configuration example of an image forming system 1 including a sheet post-processing device 5 according to a first embodiment. As illustrated in FIG. 1, the image forming system 1 includes an image forming apparatus 2 and a sheet post-processing system 3. The image forming apparatus 2 forms an image on a sheet S. The sheet post-processing system 3 includes a punch processing unit 4 and the sheet post-processing device 5. The punch processing unit 4 forms punch holes in the sheet S. The sheet post-processing device 5 performs post-processing on the sheet S. The sheet S is a sheet-shaped medium such as paper. The sheet post-processing device 5 is connected to the punch processing unit 4.

The image forming apparatus 2 includes a control panel 11, a scanner unit 12, a printer unit 13, a paper feeding unit 14, a paper discharging unit 15, and an image formation control unit 16. The control panel 11 includes various keys that receive user operations. For example, the control panel 11 receives an input related to the type of post-processing of the sheet S.

The scanner unit 12 includes a reading unit that reads image information of a to-be-copied object. The scanner unit 12 transmits the read image information to the printer unit 13. The printer unit 13 forms an output image with a developer such as toner based on the image information transmitted from the scanner unit 12 or an external device. The output image is a "toner image". The printer unit 13 transfers the toner image to the surface of the sheet S. The printer unit 13 fixes the toner image to the sheet S by applying heat and pressure to the toner image transferred to the sheet S. The paper feeding unit 14 supplies the sheets S one by one to the printer unit 13 according to the timing when the printer unit 13 forms the toner image. The paper discharging unit 15 conveys the sheet S discharged from the printer unit 13 to the sheet post-processing system 3.

The image formation control unit 16 controls the overall operations of the image forming apparatus 2. The image formation control unit 16 controls the control panel 11, the scanner unit 12, the printer unit 13, the paper feeding unit 14, and the paper discharging unit 15. The image formation control unit 16 includes a control circuit including a central processing unit (CPU), a read only memory (ROM), and a random access memory (RAM).

Figure 2:
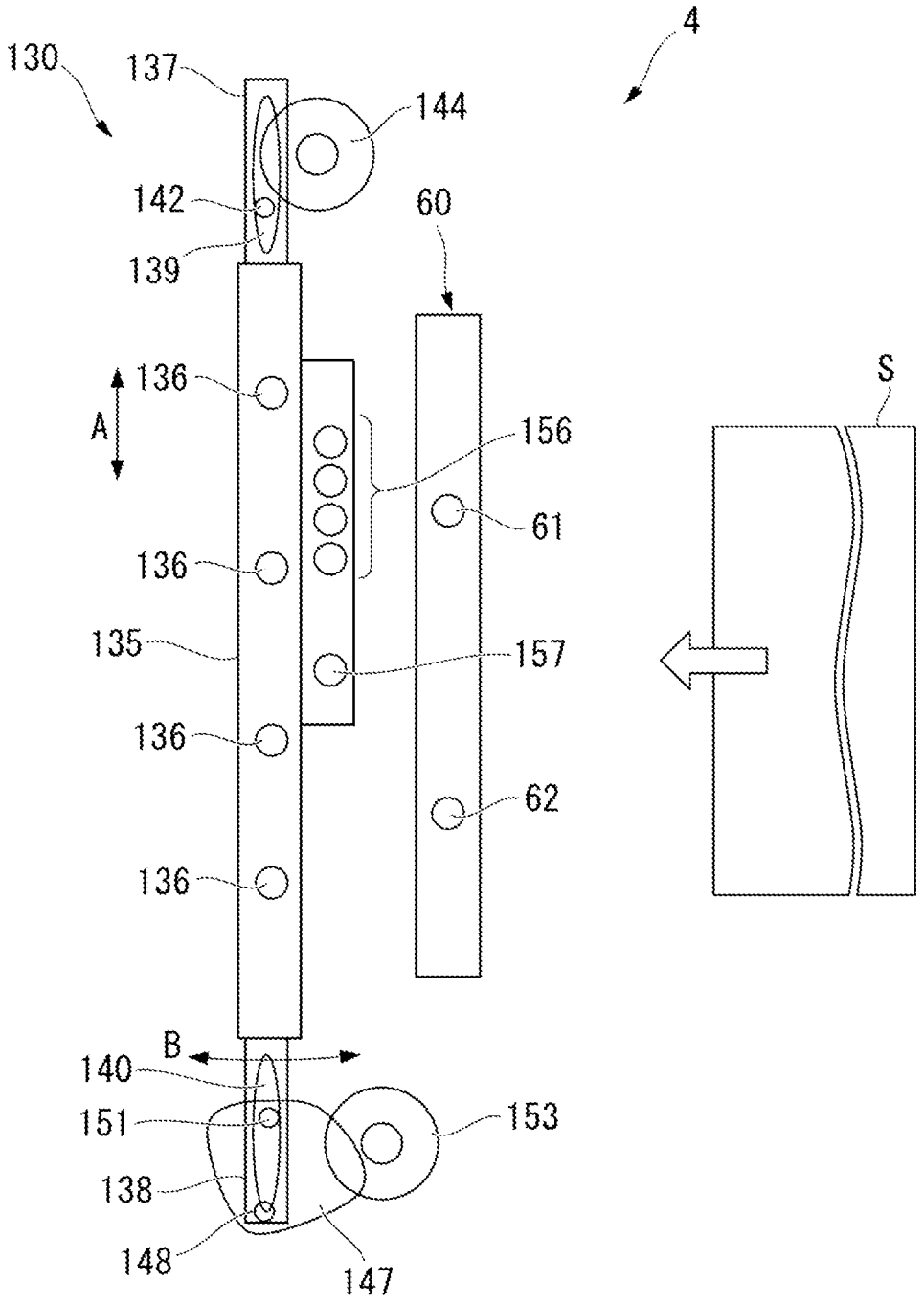
FIG. 2 is a plan view of a punch processing unit.

FIG. 2 is a plan view of the punch processing unit 4. As illustrated in FIG. 2, the punch processing unit 4 includes a punch unit 130 and a skew detection unit 60 (skew detector). The punch unit 130 includes a puncher 135. The puncher 135 includes a plurality of drilling blades 136. The drilling blades 136 form punch holes in the sheet S.

The puncher 135 has a first protrusion 137 at the first end of the puncher. The first protrusion 137 has an elongated hole 139. A fixed shaft 142 is contained in the elongated hole 139. The puncher 135 can move in the length direction within the length range of the elongated hole 139 using the fixed shaft 142 as a guide. A first actuator 144 (e.g., a motor, a lateral resist motor, etc.) moves the puncher 135 in the length direction (A direction).

The puncher 135 has a second protrusion 138 at the opposing second end of the puncher. The second protrusion 138 has an elongated hole 140. A shaft 151 is contained in the elongated hole 140. A cam 147 is coupled to the second protrusion 138. The cam 147 moves the puncher 135 in the direction intersecting the length direction (B direction). The cam 147 rotates with a shaft 148 as a fulcrum. A second actuator 153 (e.g., a motor, a vertical resist motor, etc.) rotates the cam 147. By the rotation of the cam 147, the puncher 135 rotates in the B direction with the fixed shaft 142 as a fulcrum.

A sensor 157 and a sensor group 156 are the upstream side of the puncher 135 in the conveyance direction of the sheet S. The sensor 157 detects the end portions (front end portion and rear end portion) of the sheet S in the conveyance direction. The sensor group 156 detects the end portion of the sheet S in the width direction. The width direction of the sheet S is a direction perpendicular to the conveyance direction of the sheet S. The width direction of the sheet S is the vertical direction of FIG. 2. The width direction of the sheet S is a direction that is perpendicular to the sheet conveyance direction D illustrated in FIG. 5 and is the same direction as a direction along a mounting surface 33*c* of a processing tray 33.

The skew detection unit 60 detects the skew amount of the sheet S. The skew detection unit 60 includes a first detection sensor 61, a second detection sensor 62, and a punch processing control unit 63 (refer to FIG. 3). For example, the first detection sensor 61 includes a light emitting element and a light receiving element. For example, the second detection sensor 62 includes a light emitting element and a light receiving element. The first detection sensor 61 and the second detection sensor 62 detect the sheet S passing between the light emitting element and the light receiving element by blocking the light from the light emitting element toward the light receiving element by the sheet S. The first detection sensor 61 and the second detection sensor 62 are upstream of the punch unit 130 in the conveyance direction of the sheet S. The positions of the first detection sensor 61 and the second detection sensor 62 in the width direction of the sheet S are different.

Figure 3:
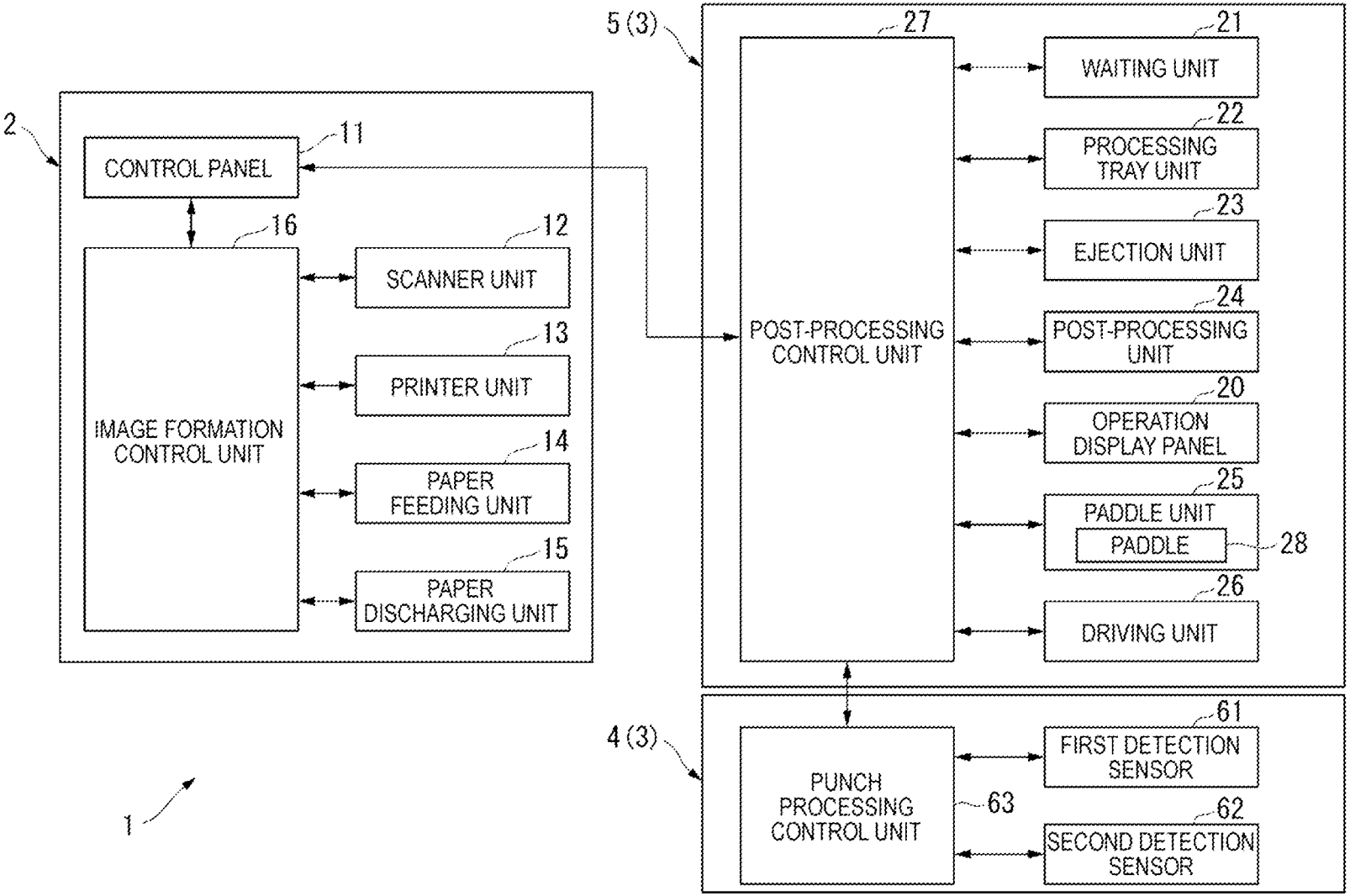
FIG. 3 is a diagram of a functional configuration example of the image forming system including the sheet post-processing device according to the first embodiment.

The first detection sensor 61 and the second detection sensor 62 detect the front end portion of the sheet S and transmit a detection signal to the punch processing control unit 63 (refer to FIG. 3). A timer counter of the punch processing control unit 63 starts time measuring when the detection sensors 61 and 62 detect the front end portion of the sheet S, respectively. When the sheet S is not tilted with respect to the conveyance direction, the detection sensors 61 and 62 detect the front end portion of the sheet S simultaneously, so that the timer counter starts counting the detection sensors 61 and 62.

When the sheet S is tilted and conveyed, there is a time difference in detection of the sheet S between the first detection sensor 61 and the second detection sensor 62. The punch processing control unit 63 (refer to FIG. 3) calculates a difference between the time point when the first detection sensor 61 detects the sheet S and the time point when the second detection sensor 62 detects the sheet S. The punch processing control unit 63 can obtain the skew error distance "a" from (i) a difference in detection time point between the first detection sensor 61 and the second detection sensor 62 and (ii) a moving speed V of the sheet S. Assuming that a distance between the first detection sensor 61 and the second detection sensor 62 is indicated by "$L_o$" and a skew angle is indicated by "θ", the following Equation (1) is satisfied.

$$a = L_o \cdot \tan\theta \quad (1)$$

FIG. 3 is a diagram of a functional configuration example of the image forming system 1 including the sheet post-processing device 5. As illustrated in FIG. 3, the punch processing unit 4 includes the punch processing control unit 63. The first detection sensor 61 and the second detection sensor 62 are connected to the punch processing control unit 63. The punch processing control unit 63 is connected to a post-processing control unit 27 of the sheet post-processing device 5.

The punch processing control unit 63 obtains the skew angle θ (skew amount) from Equation (1). The punch processing control unit 63 performs skew correction by rotating the cam 147 with the second actuator 153 to tilt the puncher 135 by the angle θ. The punch unit 130 forms a punch hole by the puncher 135 at a position of the sheet S according to the skew amount. The "position according to the skew amount" is a position skew-corrected by the punch processing control unit 63.

Figure 4:
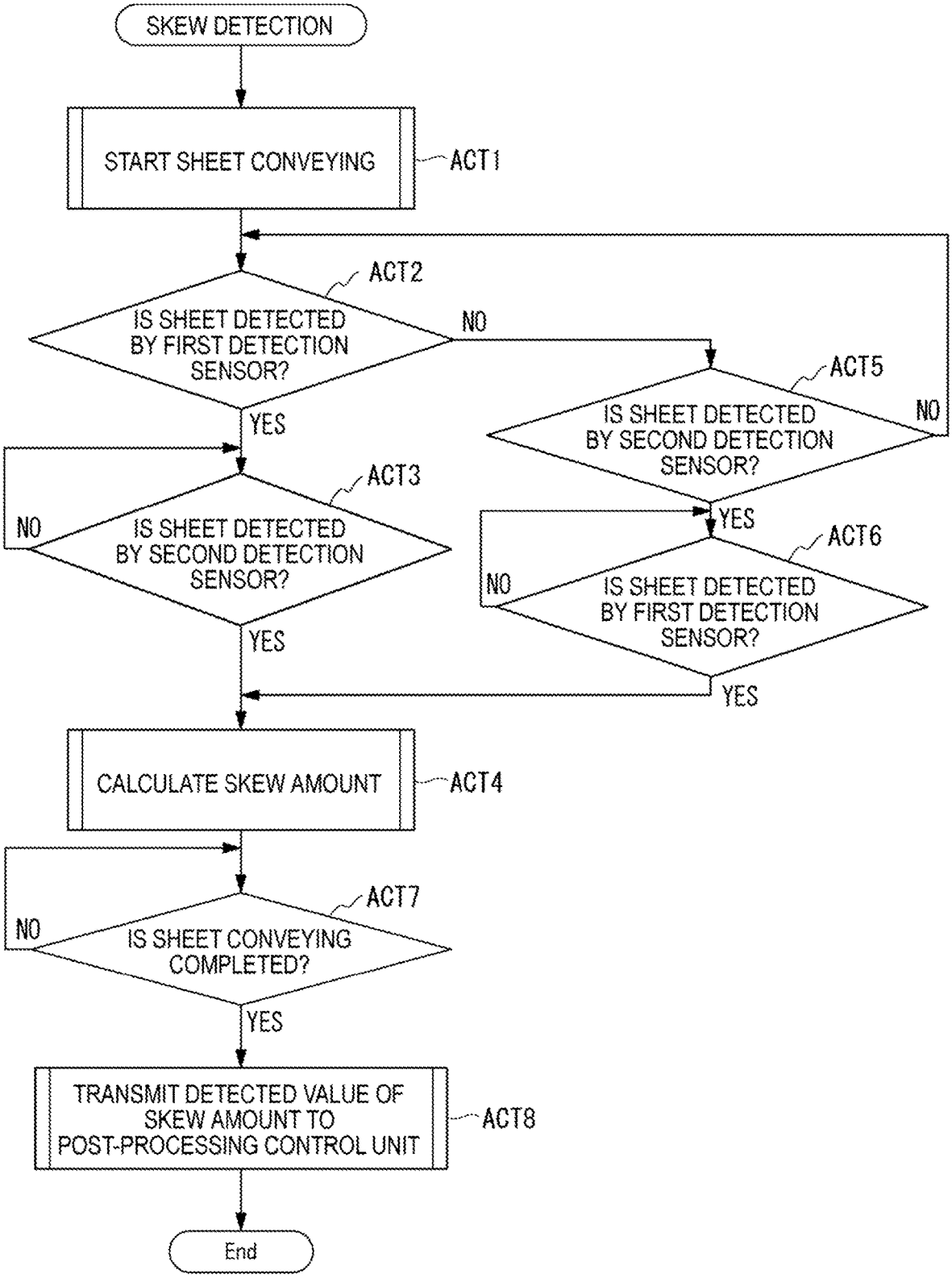
FIG. 4 is a flowchart illustrating an example of a flow of processing of the punch processing unit.

Next, a flow of processing related to skew correction in the punch processing unit 4 will be described. FIG. 4 is a flowchart illustrating an example of a flow of processing of the punch processing unit 4. As illustrated in FIG. 4, the punch processing control unit 63 operates a conveying roller of the punch processing unit 4 to start the conveying of the sheet S (ACT1). The punch processing control unit 63 determines whether the sheet S is detected by the first detection sensor 61 (ACT2). When the first detection sensor 61 detects the sheet S (ACT2: YES), the punch processing control unit 63 determines whether the second detection sensor 62 detects the sheet S (ACT3). When the second detection sensor 62 detects the sheet S (ACT3: YES), the punch processing control unit 63 calculates the skew amount based on the time difference between the detection of the sheet S of the first detection sensor 61 and the detection of the sheet S of the second detection sensor 62 (ACT4). When the second detection sensor 62 does not detect the sheet S (ACT3: NO), the punch processing control unit 63 again determines whether the second detection sensor 62 detects the sheet S (ACT3).

When the first detection sensor 61 does not detect the sheet S (ACT2: NO), the punch processing control unit 63 determines whether the sheet S is detected by the second detection sensor 62 (ACT5). If the second detection sensor 62 detects the sheet S (ACT5: YES), the punch processing control unit 63 determines whether the sheet S is detected by the first detection sensor 61 (ACT6). If the first detection sensor 61 detects the sheet S (ACT6: YES), the punch processing control unit 63 calculates the skew amount (ACT4). When the first detection sensor 61 does not detect the sheet S (ACT6: NO), the punch processing control unit 63 again determines whether the sheet S is detected by the first detection sensor 61 (ACT6). When the second detection sensor 62 does not detect the sheet S (ACT5: NO), the punch processing control unit 63 again determines whether the sheet S is detected by the first detection sensor 61 (ACT2).

After calculating the skew amount (ACT4), the punch processing control unit 63 determines whether the conveying of the sheet S is completed (ACT7). When the conveying of the sheet S is completed, the punch processing control unit 63 transmits the detected value of the skew amount of the sheet S to the post-processing control unit 27 (ACT8).

As illustrated in FIG. 1, the sheet post-processing device 5 includes an operation display panel 20, a waiting unit 21, a processing tray unit 22, an ejection unit 23, a post-processing unit 24, a paddle unit 25 (refer to FIG. 3), a driving unit 26 (a driver, an actuator, a motor, etc.)(refer to FIG. 3), and a post-processing control unit 27.

The operation display panel 20 includes buttons for the user to perform processing by the post-processing unit 24. The waiting unit 21 allows the sheet S to temporarily stay.

The processing tray unit 22 holds the sheet S or the sheet bundle S' and performs matching and discharging. The processing tray unit 22 transmits the bound sheet bundle S' to the ejection unit 23. The sheet bundle S' is a bundle configured with a plurality of the sheets S.

For example, the post-processing unit 24 includes a bind processing unit (binder) that performs bind processing (e.g., stapling) on the sheet bundle S'. The ejection unit 23 includes a fixing tray 23*a* and a paper discharging tray 23*b*. The paper discharging tray 23*b* is located on the side of the sheet post-processing device 5. The fixing tray 23*a* is located above the sheet post-processing device 5.

As illustrated in FIG. 3, the post-processing control unit 27 controls the overall operations of the sheet post-processing device 5. The post-processing control unit 27 controls the operation display panel 20, the waiting unit 21, the processing tray unit 22, the ejection unit 23, the post-processing unit 24, the paddle unit 25, and the driving unit 26. The post-processing control unit 27 is an example of the "control unit" or "controller".

The post-processing control unit 27 controls the sheet post-processing system 3 to operate in response to a control signal from the control panel 11 of the image forming apparatus 2. For example, the post-processing control unit 27 has a control circuit including a CPU, a ROM, and a RAM.

Figure 5:
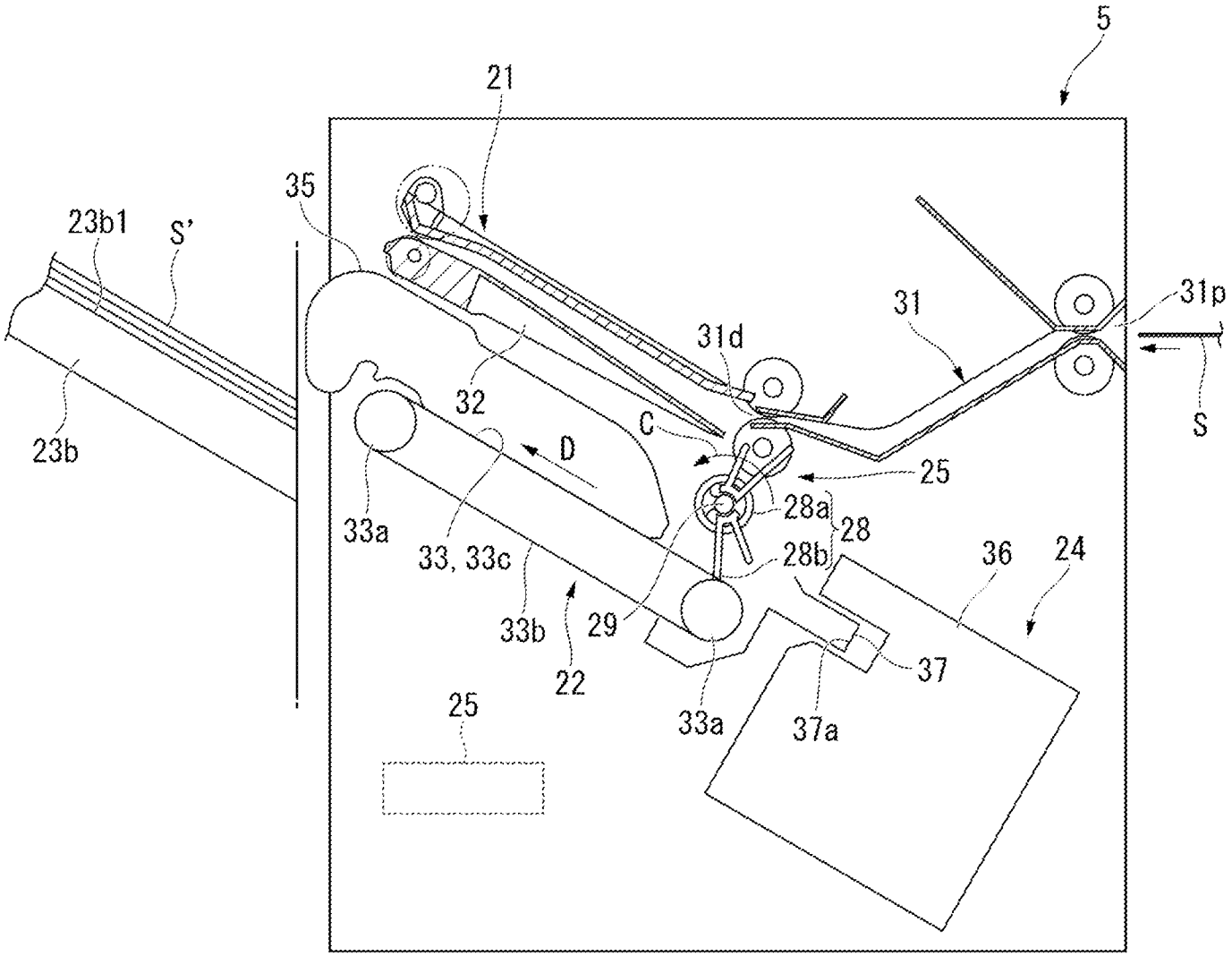
FIG. 5 is a diagram schematically illustrating a configuration of the sheet post-processing device according to the first embodiment.

The configuration of each unit of the sheet post-processing device 5 will be described in detail. FIG. 5 is a diagram schematically illustrating the configuration of the sheet post-processing device 5. As illustrated in FIG. 5, the "sheet conveyance direction D" is a direction in which the sheet bundle S' is transmitted from the processing tray 33 to the paper discharging tray 23*b*. The sheet conveyance direction D is a direction along the mounting surface 33*c* of the processing tray 33. The "upstream side" denotes an upstream side in the sheet conveyance direction D. The "downstream side" denotes a downstream side in the sheet conveyance direction D. The "rear end portion" of the sheet bundle S' denotes an "end portion of the upstream side" in the sheet conveyance direction D. A direction parallel to the mounting surface 33*c* of the processing tray 33 and perpendicular to the sheet conveyance direction D is the sheet width direction W.

The waiting unit 21 includes a waiting tray 32. The sheet S is transmitted onto the waiting tray 32 through a sheet supply port 31*p*, a conveyance path 31, and a sheet discharge port 31*d*. The sheet S is a sheet of which the skew amount is detected by the skew detection unit 60. The waiting tray 32 allows a plurality of the sheets S to wait while the processing tray unit 22 performs post-processing. When the processing tray unit 22 becomes empty, the waiting unit 21 drops the staying sheet S toward the processing tray unit 22.

The processing tray unit 22 includes the processing tray 33 and two lateral matching plates (matching plates) 35. The sheet bundle S' is mounted on the mounting surface 33*c* of the processing tray 33 while a stapler 36 binds the sheet bundle S'. The processing tray 33 includes a conveying roller 33*a* and a conveying belt 33*b*. The conveying belt 33*b* conveys the sheet bundle S' toward the paper discharging tray 23*b*.

The lateral matching plate 35 has a plate shape perpendicular to the sheet width direction W. The two lateral matching plates 35 are separated from each other in the sheet width direction W. When the sheet S on the waiting tray 32 falls on the processing tray 33, the lateral matching plate 35 performs matching to prevent disorder of the position of the sheet S on the processing tray 33 in the sheet width direction W.

The post-processing unit 24 includes the stapler (bind processing unit) 36 and a matching unit 37. The stapler 36 performs bind processing (staple processing) by driving a staple into the sheet bundle S'. The matching unit 37 is the upstream side of the processing tray 33 in the sheet conveyance direction D. The matching unit 37 has an abutting surface 37*a*. The abutting surface 37*a* is perpendicular to the sheet conveyance direction D.

The matching unit 37 matches the sheet S by abutting the rear end portion of the sheet S conveyed from the processing tray 33 on the abutting surface 37*a*. The matching unit 37 serves as a reference for the position of the sheet S during performing the matching process in the sheet conveyance direction D. The sheet S is conveyed by a paddle 28 upstream in the sheet conveying direction D to be abutted on the abutting surface 37*a*, so that the sheet S is matched with the sheet conveying direction D.

The paddle unit 25 includes one or a plurality of paddles 28 and a rotating shaft 29. The rotating shaft 29 has a length in the sheet width direction W. The rotating shaft 29 receives a driving force from the driving unit 26 (refer to FIG. 3) and rotates in the direction of arrow C in FIG. 5. The paddle 28 includes a rotating body 28*a* and one or more paddle pieces 28*b* (e.g., extensions, arms, paddles, etc.). The rotating body 28*a* rotates around the rotating shaft 29. The paddle pieces 28*b* protrude radially from the rotating body 28*a*. The paddle pieces 28*b* may be an elastic material such as rubber or resin. The paddle pieces 28*b* may be elastically bendable or deformable such that the paddle pieces 28*b* can be elastically bent or deformed to come into contact with the sheet S in a pressed state. The paddle pieces 28*b* may be elastically compressible or deformable such that the paddle pieces 28*b* can be elastically compressed or deformed to come into contact with the sheet S in a pressed state. Since the paddle 28 includes the rotating body 28*a* and the paddle pieces 28*b*, the paddle 28 can efficiently apply a force in the conveyance direction to the sheet S with the paddle pieces 28*b*.

The paddle 28 rotates in the direction C as the rotating shaft 29 is rotated by the driving unit 26. The paddle pieces 28*b* comes into contact with the sheet S on the processing tray 33 and conveys the sheet S toward the matching unit 37. The operation of the paddle 28 that applies a force in the conveyance direction to the sheet S with the paddle pieces 28*b* is called a "paddle operation". The driving unit 26 (refer to FIG. 3) rotationally drives the paddle 28 by rotating the rotating shaft 29 and allows the paddle 28 to perform the paddle operation. If there are a plurality of the paddles 28, the plurality of paddles 28 are differently positioned in the length direction of the rotating shaft 29. For example, the driving unit 26 is or includes a driving motor. The paper discharging tray 23*b* can stack the sheet bundle S' on the upper surface (mounting surface 23*b*1).

Figure 6:
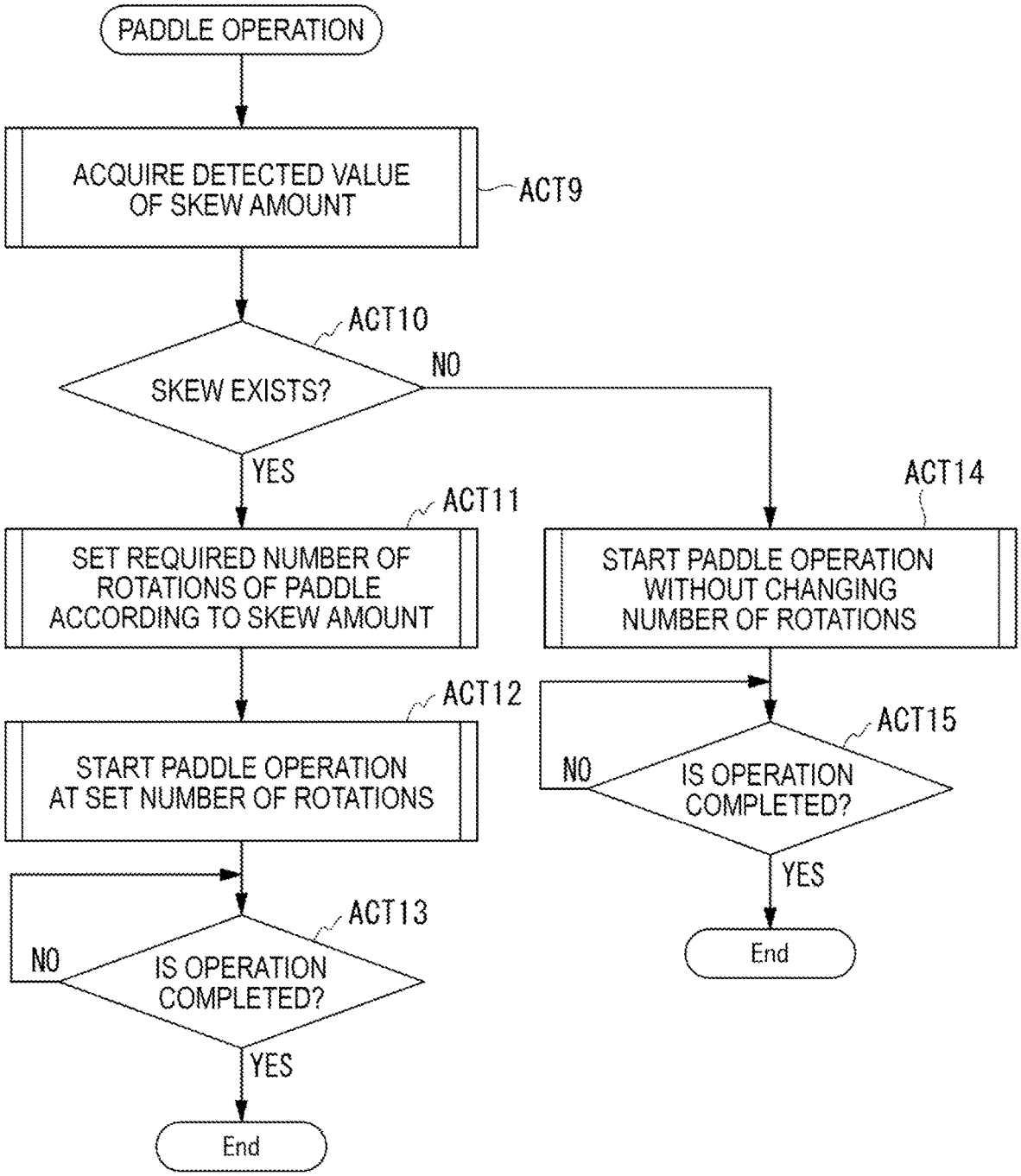
FIG. 6 is a flowchart illustrating a flow of a first example of processing of the sheet post-processing device.

Next, the flow of processing in the sheet post-processing device 5 will be described. FIG. 6 is a flowchart illustrating the flow of Example 1 of the processing of the sheet post-processing device 5. As illustrated in FIG. 6, the post-processing control unit 27 acquires the detected value of the skew amount of the sheet S (ACT5) (refer to ACT8 of FIG. 4). The post-processing control unit 27 determines whether there is skew (ACT10). For example, if the detected value of the skew amount is equal to or larger than a reference value, it is determined that there is skew (ACT10:

YES). If the detected value of the skew amount is smaller than the reference value, it is determined that there is no skew (ACT10: NO).

When it is determined that there is skew, the post-processing control unit 27 determines the number of rotations of the paddle 28 by adjusting the operation of the driving unit 26 according to the detected value of the skew amount. Specifically, the post-processing control unit 27 sets the required number of rotations of the paddle 28 according to the detected value of the skew amount (ACT11). The post-processing control unit 27 increases the number of rotations of the paddle 28 more than usual when there is skew. The set value of the number of rotations of the paddle 28 may be a fixed value or may be a value according to the detected value of the skew amount.

The post-processing control unit 27 adjusts the driving force of the driving unit 26 and starts the operation of the paddle 28 at the number of rotations determined in ACT11 (ACT12). When the number of rotations of the paddle 28 is increased, the number of times of paddle operation per unit time increases. Therefore, the paddle 28 exerts a large force on the sheet S to convey the sheet S toward the matching unit 37. The rear end portion of the sheet S is abutted on the abutting surface 37*a*, and thus, the sheet S is in a posture along the abutting surface 37*a*. The "posture along the abutting surface 37*a*" is a posture in which the rear end portion is perpendicular to the sheet conveyance direction D. By allowing the rear end portion of the sheet S to be in a posture along the sheet conveyance direction D, the skew of the sheet S is corrected. The post-processing control unit 27 determines whether the operation of conveying the sheet S to the matching unit 37 is completed (ACT13).

If the post-processing control unit 27 determines that there is no skew (ACT10: NO), the post-processing control unit 27 starts the operation of the paddle 28 without changing the number of rotations (ACT14). Since the number of rotations of the paddle 28 does not increase, the number of times of paddle operation does not increase, and thus, damage to the sheet S can be prevented. The post-processing control unit 27 adjusts the posture of the sheet S by controlling the number of times of paddle operation of the paddle 28 (ACTs 11 and 14) based on the detected value of the skew amount. The post-processing control unit 27 determines whether the operation of conveying the sheet S to the matching unit 37 is completed (ACT15).

As illustrated in FIG. 5, the stapler 36 performs bind processing (staple processing) by driving a staple into the sheet bundle S'. The processing tray 33 conveys the bound sheet bundle S' toward the paper discharging tray 23*b*.

According to the sheet post-processing device 5, the post-processing control unit 27 adjusts the posture of the sheet S by controlling the number of times of paddle operation of the paddle 28 based on the detected value of the skew amount transmitted from the punch processing unit 4, it is possible to bind the sheet bundle S' in the correct posture. In the sheet post-processing device 5, since the value of the skew amount detected by the punch processing unit 4 is used, it is not necessary to provide a dedicated configuration for detecting the skew amount. Since the sheet post-processing device 5 can simplify the device configuration, the sheet post-processing device 5 can be miniaturized.

In the sheet post-processing device 5, since the number of times of paddle operation is determined by controlling the number of rotations of the paddle 28, it is possible to determine the number of times of paddle operation accurately by a simple device configuration.

Figure 7:
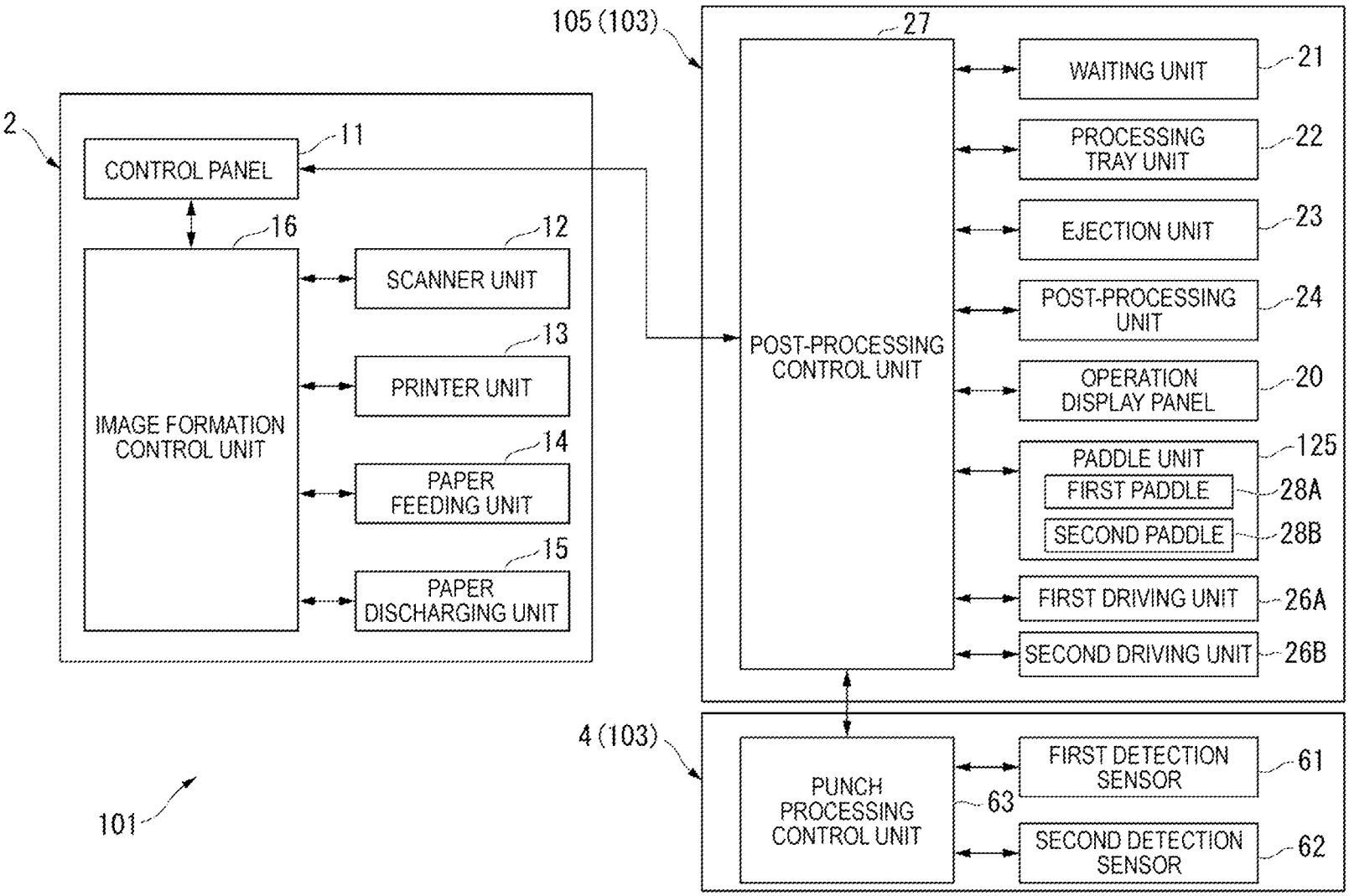
FIG. 7 is a diagram of a functional configuration example of an image forming system including a sheet post-processing device according to a second embodiment.

Next, a sheet post-processing device according to the second embodiment will be described. FIG. 7 is a diagram of a functional configuration example of an image forming system 101 including a sheet post-processing device 105 according to a second embodiment. The same components as that of the sheet post-processing device 5 according to the first embodiment are denoted by the same reference numerals, and the description thereof will be omitted. As illustrated in FIG. 7, the image forming system 101 includes an image forming apparatus 2 and a sheet post-processing system 103. The sheet post-processing system 103 includes a punch processing unit 4 and a sheet post-processing device 105. The sheet post-processing device 105 is different from the sheet post-processing device 5 (refer to FIG. 3) according to the first embodiment in that a paddle unit 125 is used instead of the paddle unit 25. The sheet post-processing device 105 is also different from the sheet post-processing device 5 (refer to FIG. 3) in that the sheet post-processing device 105 includes two driving units 26A and 26B.

Figure 8:
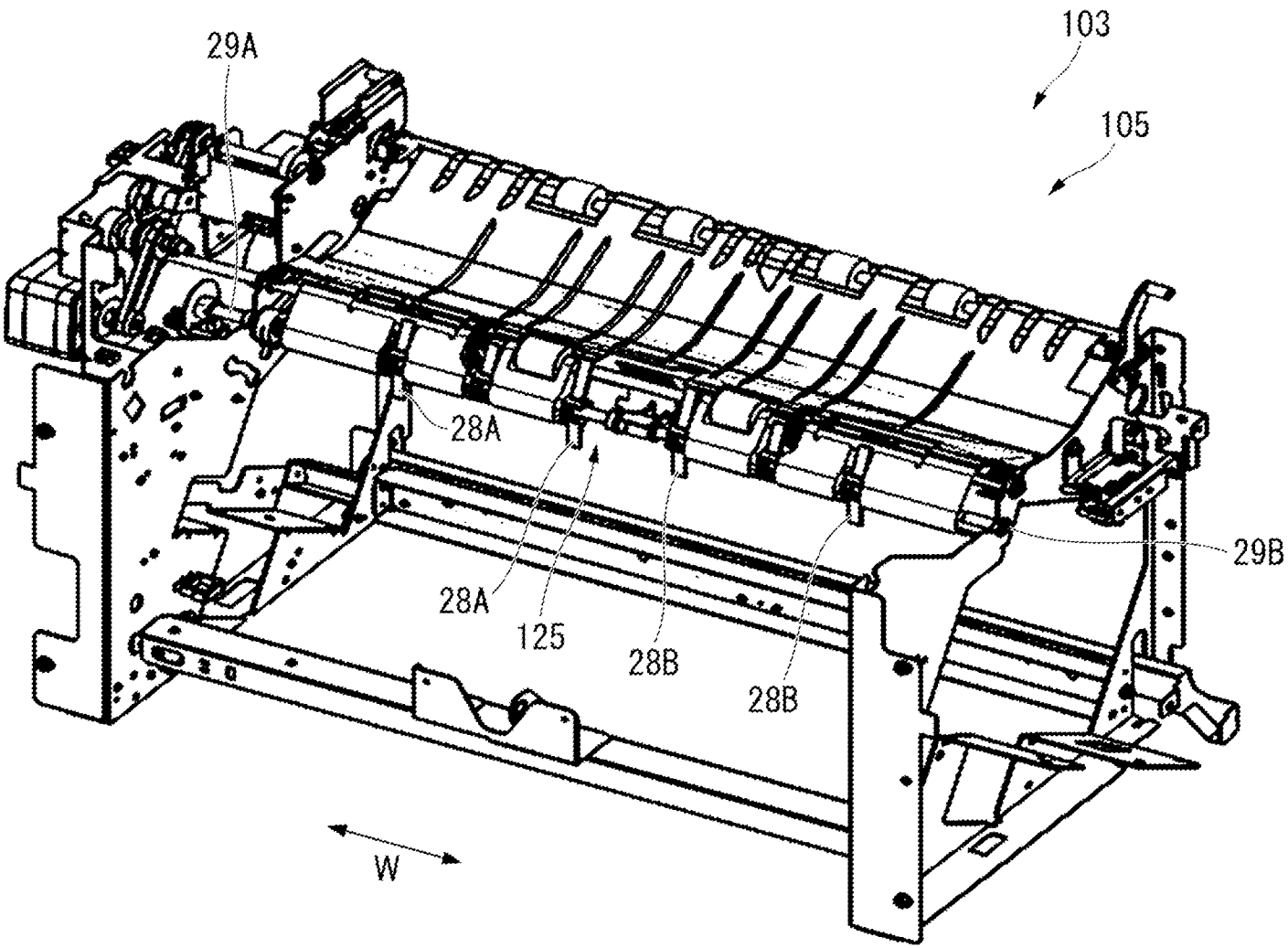
FIG. 8 is a perspective view of a portion of the sheet post-processing device according to the second embodiment.

FIG. 8 is a perspective view of a portion of the sheet post-processing device 105. As illustrated in FIG. 8, the paddle unit 125 includes one or a plurality of first paddles 28A, one or a plurality of second paddles 28B, a first rotating shaft 29A, and a second rotating shaft 29B.

The first paddles 28A rotate around the first rotating shaft 29A. The second paddles 28B rotate around the second rotating shaft 29B. The positions of the first rotating shaft 29A and the second rotating shaft 29B in the sheet width direction W are different. Since the positions of the two rotating shafts 29A and 29B are different, the positions of the first paddles 28A and the second paddles 28B in the sheet width direction W are different. In the embodiment, there are a plurality of the first paddles 28A. The positions of the plurality of first paddles 28A in the length direction of the first rotating shaft 29A are different. There are a plurality of the second paddles 28B. The positions of the plurality of second paddles 28B in the length direction of the second rotating shaft 29B are different. The first rotating shaft 29A and the second rotating shaft 29B can rotate independently based on independent operation of the driving units 26A and 26B. Since the two rotating shafts 29A and 29B rotate independently, the first paddles 28A and the second paddles 28B can rotate independently.

The first paddles 28A and the second paddles 28B have the same configuration as the paddle 28 in the sheet post-processing device 5 (refer to FIG. 5). Both the first paddles 28A and the second paddles 28B include a rotating body 28*a* and one or more paddle pieces 28*b* (refer to FIG. 5).

For example, the first paddles 28A and the second paddle 28B have the same shape. If the first paddles 28A and the second paddles 28B have the same shape, the carrying forces exerted by the first paddles 28A and the second paddles 28B on the sheet S become the same, and thus, the operation conditions of the first paddles 28A and the second paddles 28A can be allowed to be equivalent, so that the control becomes easy.

For example, the paddle pieces 28*b* of the first paddles 28A and the paddle pieces 28*b* of the second paddles 28B have the same elasticity (bending elasticity or compressive elasticity). If the paddle pieces 28*b* of the first paddles 28A and the paddle pieces 28*b* of the second paddles 28B have the same elasticity, the carrying forces exerted by the first paddles 28A and the second paddles 28B on the sheet S becomes the same, and thus, the operating conditions of the first paddles 28A and the second paddles 28B can be allowed to be equivalent, so that the control becomes easy.

As illustrated in FIG. 7, the sheet post-processing device 105 includes the first driving unit 26A and the second driving unit 26B. The first driving unit 26A drives the first paddles 28A through the first rotating shaft 29A to allow the first paddles 28A to perform a first paddle operation. The second driving unit 26B drives the second paddles 28B through the second rotating shaft 29B to allow the second paddle 28B to perform a second paddle operation. The first driving unit 26A and the second driving unit 26B operate independently. For example, the first driving unit 26A and the second driving unit 26B are driving motors.

Figure 9:
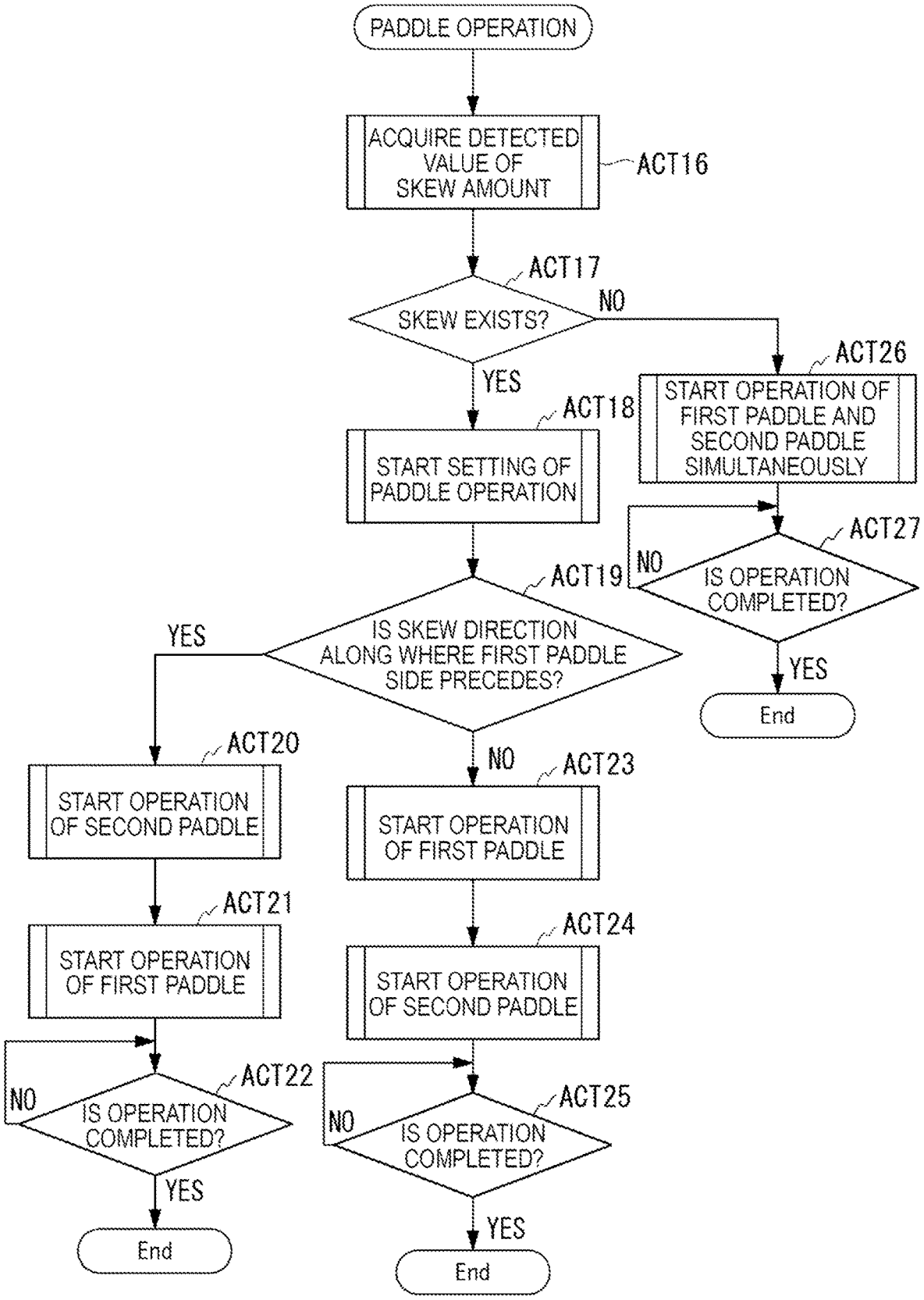
FIG. 9 is a flowchart illustrating a flow of a second example of processing of the sheet post-processing device.

Next, the flow of processing in the sheet post-processing device 105 will be described. FIG. 9 is a flowchart illustrating the flow of Example 2 of the processing of the sheet post-processing device 105. As illustrated in FIG. 9, the post-processing control unit 27 acquires the detected value of the skew amount of the sheet S (ACT16) (refer to ACT8 of FIG. 4). The post-processing control unit 27 determines whether there is skew (ACT17) (refer to ACT10 of FIG. 6).

When it is determined that there is skew (ACT17: YES), the post-processing control unit 27 starts setting of the operations of the paddles 28A and 28B (ACT18). The post-processing control unit 27 determines whether the skew of the sheet S is a skew in the direction in which the side at which the first paddles 28A are positioned precedes (ACT19). When the skew of the sheet S is the skew in the direction in which the side at which the first paddles 28A are positioned precedes (ACT19: YES), the post-processing control unit 27 starts the rotation of the second paddles 28B first with the second driving unit 26B (ACT20). After a period of time, the first driving unit 26A starts the rotation of the first paddles 28A (ACT21). Since the operations of the paddles 28A and 28B start in order of the second paddles 28B and then the first paddles 28A, the number of times of second paddle operation of the second paddles 28B becomes larger than the number of times of the first paddle operation of the first paddles 28A. The time difference between the start of operation of the second paddles 28B and the start of operation of the first paddles 28A can be set according to the skew amount. Since the second paddles 28B operates first, the skew of the sheet S is corrected. The post-processing control unit 27 determines whether the operation of conveying the sheet S is completed and ends when the operation is completed (ACT22).

When the skew of the sheet S is not the skew in the direction in which the side at which the first paddles 28A are positioned precedes (ACT19: NO), the post-processing control unit 27 starts the rotation of the first paddles 28A first with the first driving unit 26A (ACT23). After a period of time, the second driving unit 26B starts the rotation of the second paddles 28B (ACT24). Since the post-processing control unit 27 starts the operations of the paddles 28A and 28B in order of the first paddle 28A and then the second paddle 28B, the number of times of the first paddle operation of the first paddles 28A is larger than the number of times of the second paddle operation of the second paddles 28B. The time difference between the start of operation of the first paddles 28A and the start of operation of the second paddles 28B can be set according to the skew amount. "When the skew is not the skew in the direction in which the first paddle 28A side precedes" denotes that the skew of the sheet S is the skew in the direction in which the side at which the second paddles 28B are positioned precedes. Since the first paddles 28A operates first, the skew of the sheet S is corrected. The post-processing control unit 27 determines whether the operation of conveying the sheet S is completed and ends when the operation is completed (ACT25).

When the post-processing control unit 27 determines that there is no skew (ACT17: NO), the post-processing control unit 27 drives the first driving unit 26A and the second driving unit 26B simultaneously to start the operations of the first paddles 28A and the second paddles 28B simultaneously (ACT26). Since the first paddles 28A and the second paddles 28B start the operations simultaneously, the sheet S is maintained in a no-skew state. The post-processing control unit 27 determines whether the operation of conveying the sheet S is completed by the paddle 28, and ends when the operation is completed (ACT27).

According to the sheet post-processing device 105, the post-processing control unit 27 adjusts the posture of the sheet S by controlling the number of times of the first paddle operation of the first paddle 28A and the number of times of the second paddle operation of the second paddle 28B based on the detected value of the skew amount transmitted from the punch processing unit 4, it is possible to bind the sheet bundle S' in the correct posture. In the sheet post-processing device 105, since the value of the skew amount detected by the punch processing unit 4 is used, it is not necessary to provide a dedicated configuration for detecting the skew amount. Since the sheet post-processing device 105 can simplify the device configuration, the sheet post-processing device 105 can be miniaturized.

According to the sheet post-processing device 105, since the first driving unit 26A and the second driving unit 26B operate independently, the first paddles 28A and the second paddles 28B can be operated independently. Since the sheet post-processing device 105 can set any force applied to the sheet S by the first paddles 28A and any force applied to the sheet S by the second paddles 28B, it is possible to perform skew correction with a high accuracy.

In the sheet post-processing device 105, since the number of times of paddle operation is determined by selecting the order of the operation start of the first paddles 28A and the operation start of the second paddles 28B, it is possible to determine the number of times of paddle operation accurately by a simple device configuration.

The number of times of paddle operations of the paddles 28A and 28B are not limited to the order of starts of operations of the paddles 28A and 28B, but may be determined by the number of rotations of the paddles 28A and 28B. For example, when the skew of the sheet S is the skew in the direction in which the first paddle 28A side precedes (ACT19: YES), the post-processing control unit 27 increases the number of rotations of the second paddles 28B by the second driving unit 26B. The number of rotations of the first paddles 28A does not change. The operations of the first paddles 28A and the second paddles 28B may start simultaneously. When the skew of the sheet S is not the skew in the direction in which the first paddles 28A side precedes (ACT19: NO), the post-processing control unit 27 increases the number of rotations of the first paddles 28A by the first driving unit 26A. The number of rotations of the second paddles 28B does not change. The operations of the first paddles 28A and the second paddles 28B may start simultaneously.

The image forming system 1 illustrated in FIG. 1 can also take a form in which the punch processing unit 4 is removed. The form is called a "subform". The subform image forming system 1 includes the image forming apparatus 2 and the sheet post-processing device 5. When the image forming system 1 takes the subform, since the detected value of the skew amount cannot be acquired from the punch processing unit 4, the post-processing control unit 27 does not control the number of times of the paddle operation of the paddles 28.

The normal form (refer to FIG. 1) in which the punch processing unit 4 is not removed is referred to as a "main form". When the image forming system 1 takes the main form, since the detected value of the skew amount can be acquired from the punch processing unit 4, the post-processing control unit 27 controls the number of times of paddle operation of the paddles 28.

Since the image forming system 1 can take a plurality of forms (main form and sub form), the image forming system 1 can be widely used according to the purpose of use of the sheet post-processing system.

Figure 10:
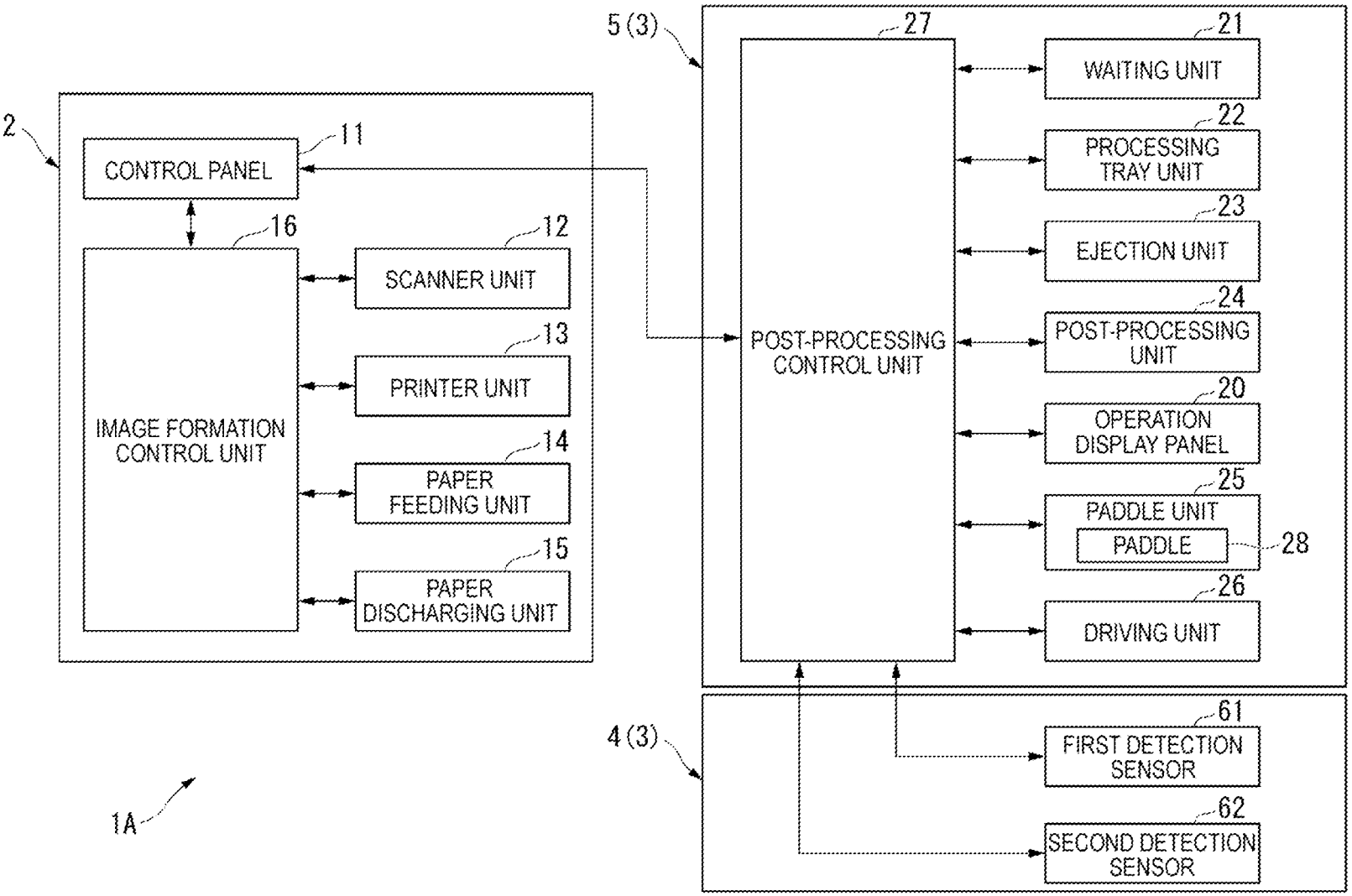
FIG. 10 is a diagram of a functional configuration example of Modified Example 1 of the image forming system including the sheet post-processing device according to the first embodiment.

FIG. 10 is a diagram of a functional configuration example of an image forming system 1A, which is Modified Example 1 of the image forming system 1. As illustrated in FIG. 10, the image forming system 1A is different from the image forming system 1 illustrated in FIG. 3 in that the image forming system 1A does not include the punch processing control unit 63. In the image forming system 1A, the first detection sensor 61 and the second detection sensor 62 transmit a detection signal to the post-processing control unit 27. The post-processing control unit 27 calculates the skew amount. The post-processing control unit 27 controls the number of times of paddle operations of the paddles 28 based on the detected value of the skew amount.

Figure 11:
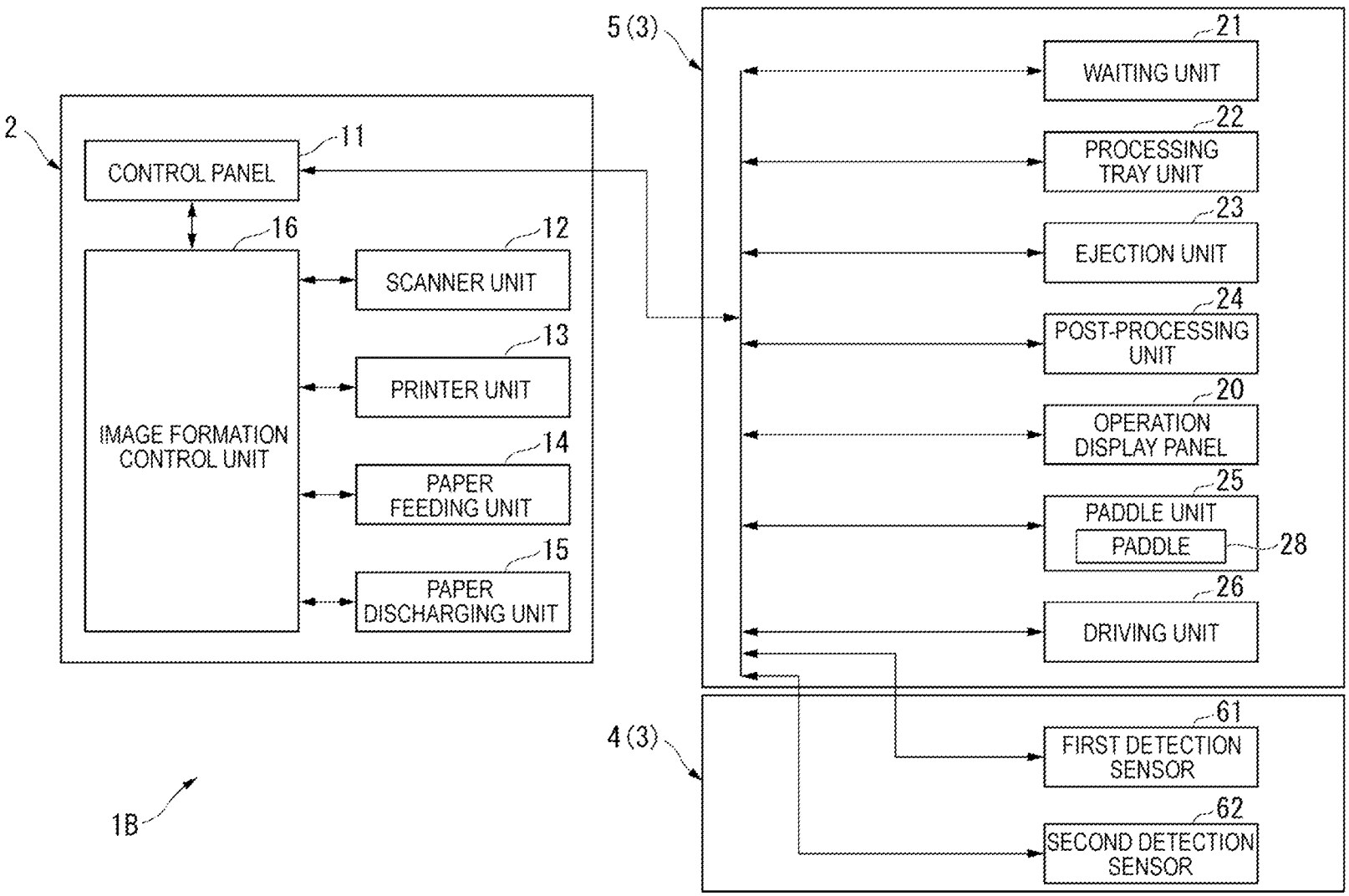
FIG. 11 is a diagram of a functional configuration example of Modified Example 2 of the image forming system including the sheet post-processing device according to the first embodiment.

FIG. 11 is a diagram of a functional configuration example of an image forming system 1B, which is Modified Example 2 of the image forming system 1. As illustrated in FIG. 11, the image forming system 1B is different from the image forming system 1 illustrated in FIG. 3 in that the image forming system 1B does not include the post-processing control unit 27 and the punch processing control unit 63. In the image forming system 1B, the image formation control unit 16 is connected to the operation display panel 20, the waiting unit 21, the processing tray unit 22, the ejection unit 23, the post-processing unit 24, the paddle unit 25 (refer to FIG. 3), and the driving unit 26 (refer to FIG. 3), the first detection sensor 61, and the second detection sensor 62.

In the image forming system 1B, the first detection sensor 61 and the second detection sensor 62 transmit a detection signal to the image formation control unit 16 through the control panel 11. The image formation control unit 16 calculates the skew amount. The image formation control unit 16 controls the number of times of paddle operation of the paddles 28 based on the detected value of the skew amount.

In the first and second embodiments, two detection sensors 61 and 62 are used, but the number of detection sensors is not particularly limited. The number of detection sensors may be any number of two or more. In the second embodiment, the first paddles 28A and the second paddles 28B are used, but the number of paddles is not particularly limited. The number of paddles may be any number of two or more. In the second embodiment, the first driving unit 26A and the second driving unit 26B are used, but the number of driving units is not particularly limited. The number of driving units may be any number of two or more. In the first and second embodiments, the post-processing unit 24 includes the bind processing unit, but the post-processing unit is not limited to the bind processing unit but may include a sort processing unit and the like.

According to at least one embodiment described above, since the post-processing control unit 27 controls the number of times of paddle operation of the paddles 28 based on the detected value of the skew amount transmitted from the punch processing unit 4, it is possible to perform the bind processing on the sheet bundle S' in a correct posture.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet post-processing device connected to a punch processing unit including a skew detection unit that detects a skew amount of a sheet and a punch unit that forms punch holes at positions of the sheet according to the skew amount, the sheet post-processing device comprising:

a processing tray on which the sheet of which the skew amount is detected by the skew detection unit is mounted;

a paddle that conveys the sheet on the processing tray by performing a paddle operation;

a driver that drives the paddle to perform the paddle operation; and a control unit configured to operate the driver to control a number of times the paddle operation is performed by the paddle based on the skew amount.

2. The sheet post-processing device of claim 1, wherein the paddle includes a plurality of paddles.

3. The sheet post-processing device of claim 2, wherein the plurality of paddles include a first paddle and a second paddle spaced from the first paddle in a width direction perpendicular to a conveyance direction of the sheet.

4. The sheet post-processing device of claim 3, wherein the driver includes a first driver that drives the first paddle to perform a first paddle operation and a second driver that drives the second paddle to perform a second paddle operation independent of the first paddle operation.

5. The sheet post-processing device of claim 4, wherein the control unit is configured to control a timing between starting the first paddle operation of the first paddle and the second paddle operation of the second paddle based on the skew amount.

6. The sheet post-processing device of claim 3, wherein the first paddle and the second paddle have the same shape.

7. The sheet post-processing device of claim 6, wherein the paddle piece of the first paddle and the paddle piece of the second paddle have the same elasticity.

8. The sheet post-processing device of claim 1, wherein the paddle includes a rotating body and a paddle arm that protrudes from the rotating body and comes into contact with the sheet.

9. The sheet post-processing device of claim 1, wherein the paddle rotates, and the control unit is configured to control the number of rotations of the paddle based on the skew amount.

10. The sheet post-processing device of claim 1, further comprising an abutment surface positioned proximate an end of the processing tray and perpendicular to a conveyance direction of the sheet, wherein the control unit is configured operate the driver such that the paddle conveys the sheet into the abutment surface, and wherein the number of times of the paddle operation of the paddle is a first number of paddle operations when the sheet is not skewed and a second number of paddle operations different than the first number of paddle operations when the sheet is skewed.

11. The sheet post-processing device of claim 10, wherein the second number of paddle operations is greater than the first number of paddle operations.

12. The sheet post-processing device of claim 1, further comprising a binder that performs bind processing on the sheet.

13. The sheet post-processing device of claim 1, wherein when a detected value of the skew amount can be obtained from the punch processing unit, the control unit is configured to control the number of times of the paddle operation of the paddle based on the detected value of the skew amount, and wherein when the detected value of the skew amount cannot be obtained from the punch processing unit, the control unit does not control the number of times of the paddle operation of the paddle based on the detected value of the skew amount.

14. A sheet post-processing system comprising:

a skew detector positioned to monitor a sheet as the sheet passes thereby to facilitate detecting a skew amount of the sheet;

a tray positioned downstream of the skew detector and that receives the sheet;

a drive assembly positioned to facilitate repositioning the sheet along the tray, wherein the drive assembly includes a first actuator, a first shaft coupled to the first actuator, a first paddle arm coupled to the first shaft, a second actuator, a second shaft coupled to the second actuator, a second paddle arm coupled to the second shaft, and wherein the first paddle arm and the second paddle arm engage with the sheet; and a controller configured to operate the drive assembly to correct the skew amount of the sheet.

15. The sheet post-processing system of claim 14, wherein the first actuator drives the first paddle arm to perform a first paddle operation and the second actuator drives the second paddle arm to perform a second paddle operation independent of the first paddle operation, and wherein the controller is configured to control a timing between starting the first paddle operation of the first paddle arm and the second paddle operation of the second paddle arm based on the skew amount.

16. The sheet post-processing system of claim 14, further comprising a punch unit positioned between the skew detector and the tray, wherein the punch unit is configured to form punch holes at positions of the sheet, and wherein the punch unit is configured to selectively reposition to accommodate the skew amount.

* * * * *